US009815084B2

(12) United States Patent
Hwang

(10) Patent No.: US 9,815,084 B2
(45) Date of Patent: Nov. 14, 2017

(54) CLEAR COATING METHOD, COATING METHOD, AND COATING FILM STRUCTURE

(71) Applicant: NISSAN MOTOR CO., LTD., Yokohama-shi, Kanagawa (JP)

(72) Inventor: Inhye Hwang, Busan (KR)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 96 days.

(21) Appl. No.: 14/890,571

(22) PCT Filed: Apr. 23, 2014

(86) PCT No.: PCT/JP2014/061430
§ 371 (c)(1),
(2) Date: Nov. 11, 2015

(87) PCT Pub. No.: WO2014/185236
PCT Pub. Date: Nov. 20, 2014

(65) Prior Publication Data

US 2016/0121367 A1 May 5, 2016

(30) Foreign Application Priority Data

May 13, 2013 (JP) ..... 2013-101680

(51) Int. Cl.
*B05D 7/00* (2006.01)
*B05D 1/36* (2006.01)
*B05D 1/02* (2006.01)

(52) U.S. Cl.
CPC ..... *B05D 7/532* (2013.01); *B05D 1/36* (2013.01); *B05D 7/53* (2013.01); *B05D 7/577* (2013.01); *B05D 1/02* (2013.01); *B05D 7/572* (2013.01)

(58) Field of Classification Search
None
See application file for complete search history.

(56) References Cited

U.S. PATENT DOCUMENTS 6,652,919 B1 * 11/2003 Campbell ..... B05D 7/574 427/379
2008/0226891 A1 * 9/2008 Chiga ..... B05D 7/577 428/221

(Continued)

FOREIGN PATENT DOCUMENTS

GB 2 447 741 A 9/2008
JP 6-142565 A 5/1994

(Continued)

*Primary Examiner* — Michael P Rodriguez
(74) *Attorney, Agent, or Firm* — Foley & Lardner LLP

(57) ABSTRACT

A clear coating method comprising: applying a clear paint on a topcoat base coating film (21) under a first coating condition, and thereby forming a first wet clear coating film in a first stage (14A); successively applying a clear paint on the first wet clear coating film under a second coating condition different from the first coating condition without baking the first wet clear coating film, and thereby forming a second wet clear coating film in a second stage (14B); and baking the first wet clear coating film and the second wet clear coating film and thereby forming a clear coating film, wherein a painted non-volatility value of the clear paint in the second stage is larger than a painted non-volatility value of the clear paint in the first stage, an average atomized paint particle size of the clear paint in the second stage is smaller than an average atomized paint particle size of the clear paint in the first stage, and a thickness of the second wet clear coating film is thinner than a thickness of the first wet clear coating film.

2 Claims, 8 Drawing Sheets

(56) References Cited

U.S. PATENT DOCUMENTS

| | | | | |
|---|---|---|---|---|
| 2011/0014461 | A1* | 1/2011 | Li | B05D 5/065 428/341 |
| 2011/0159197 | A1* | 6/2011 | Kurata | B05B 3/1092 427/421.1 |

FOREIGN PATENT DOCUMENTS

| | | | | |
|---|---|---|---|---|
| JP | 11-253877 | A | | 9/1999 |
| JP | 2001-46952 | A | | 2/2001 |
| JP | 2003-71379 | A | | 3/2003 |
| JP | 2003071379 | A | * | 3/2003 |
| JP | 2003-277678 | A | | 10/2003 |
| JP | 2008-1036 | A | | 1/2008 |
| JP | 2011-72997 | A | | 4/2011 |

* cited by examiner

CLEAR COATING METHOD, COATING METHOD, AND COATING FILM STRUCTURE

TECHNICAL FIELD

The present invention relates to an exterior part coating method including a clear coating method and a coating film structure.

BACKGROUND ART

In order to enhance the finished appearance quality of a vehicle body, a so-called double clear coating method is known (see Patent Document 1 below). In this conventional double clear coating method, a first clear paint is applied to the surface of a wet topcoat base film in a wet on wet condition to form a first wet clear film. Thereafter, a second clear paint having a lower viscosity than that of the first clear paint is applied to the surface of the first wet clear film to form a second wet clear film, and a double clear film is thus formed.

PRIOR ART DOCUMENT

Patent Document

[Patent Document 1] JP 11-253877 A

SUMMARY OF INVENTION

Problems to be Solved by Invention

However, if the double clear film is formed in the wet on wet condition, and the viscosity of the second clear paint is set lower than that of the first clear paint so as to make the clear coating film thick, a flow-down defect of a wet clear coating film will occur, in particular, such as on a vertical surface of a vehicle body. On the other hand, if the viscosity of the first clear paint is set higher than that of the second clear paint so as to make the clear coating film thick, a defect of generation of bubbles will occur. Thus, the above conventional double clear coating method with viscosity adjustment cannot make the clear coating film thick, and has limitations in the image sharpness or the gloss.

A problem to be solved by the present invention is to provide a high image sharpness topcoat film which can be cheaply produced.

Means for Solving Problems

The present invention comprises a first stage of thickly applying a clear paint having a small painted non-volatility value and large average atomized paint particle size, and a second stage of thinly applying a clear paint having a large painted non-volatility value and small average atomized paint particle size. The problem is, thereby, solved by the present invention.

Effect of Invention

According to the present invention, a clear paint is applied thickly in the first stage under a first coating condition in which the clear paint has a small painted non-volatility value and a large average atomized paint particle size, thereby to ensure the film thickening and the coating film flowability. On the other hand, a clear paint is applied thinly in the second stage under a second coating condition in which the clear paint has a large painted non-volatility value and a small average atomized paint particle size, thereby to smooth or flatten the roughness of the clear coating film surface formed in the first stage. Concurrently, self leveling action on the surface is achieved because the flowability can be ensured to some extent due to supply of the solvent from the underlying clear coating film.

MODE(S) FOR CARRYING OUT THE INVENTION

Figure 1:
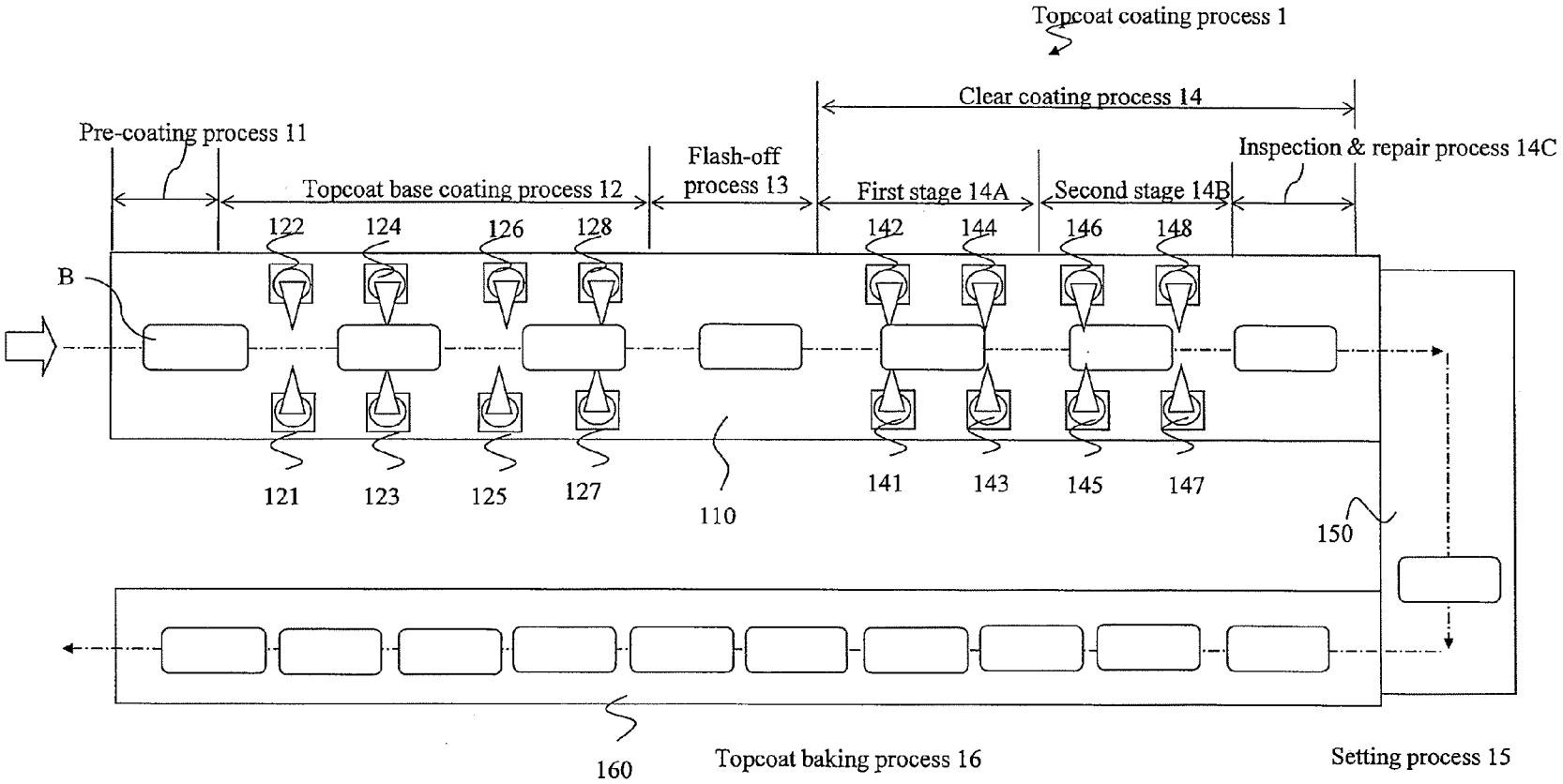
FIG. 1 is a process diagram showing a topcoat coating process for vehicle bodies to which an embodiment of the clear coating method according to the present invention is applied.

Hereinafter, an embodiment of the present invention will be described with reference to the drawings. The clear coating method and topcoat coating method according to the present invention can be applied to a coating line for vehicle bodies or vehicle components. Embodiments will be exemplified below in which the present invention is applied to a topcoat coating process for vehicle bodies. The present invention, however, can be applied to a component coating process for bumpers and can also be applied to cases in which lid components, such as door assemblies, hood assemblies, back door assemblies and trunk lid assemblies, are formed of resin and the formed components are coated in a coating process separate from the coating line for vehicle bodies.

Overview of a coating line for vehicle bodies will first be described. A white body having been assembled in a body welding production line is first carried into an under coating process. In this under coating process, the white body is rinsed and washed to remove undesired substances, such as oils and iron powder, attached to the white body, and then followed by surface conditioning treatment and by chemical conversion film treatment such as using zinc phosphate (this is the rinse/pretreatment process). Subsequently, electrodeposition coating is performed for forming undercoat. After being applied with an electrodeposition paint of which the base resin is epoxy-based resin such as polyamine resin, the body is conveyed into an electrodeposition oven and baked therein under 160° C. to 180° C. for 15 to 30 minutes, for example. This allows an electrodeposition coating film to be formed with a film thickness of 10 μm to 35 μm on the interior and exterior parts of the body and on the hollow structure part (this is the electrodeposition process).

The body formed with the electrodeposition coating film is conveyed to a sealing process (including a floor back coating process and a stone-guard coating process) in which, for the purpose of anti-rust or sealing, a sealing material of vinyl chloride-based resin is applied to joining parts of steel panels of the body and edge parts of steel panels of the body. In the floor back coating process, a vinyl chloride resin-based anti-flipped stone material is applied to wheel housings of the body and a floor back of the body. In the stone-guard coating process, an anti-flipped stone material of polyester-based resin or polyurethane-based resin is applied to the lower portion of a body exterior part, such as a sill panel and a fender panel. These sealing material and anti-flipped stone material applied to the body are cured in a dedicated oven, or in an intermediate coating oven which will be described below.

After being formed with the electrodeposition coating film on the interior and exterior parts of the body and applied with the sealing material and anti-flipped stone material, the body is conveyed into an intermediate coating process. The intermediate coating process has an intermediate coating booth and an intermediate coating oven. In the intermediate coating booth, an interior coating paint corresponding to an exterior body color of the vehicle body is applied to the body interior part, and thereafter an intermediate paint is applied to the body exterior part in a wet on wet condition. This body is conveyed into the intermediate coating oven and passes therethrough under 130° C. to 150° C. for 15 to 30 minutes, for example, thereby being formed with an intermediate coating film of a film thickness of 15 μm to 35 μm on the body exterior part and an interior coating film of a film thickness of 15 μm to 30 μm on the body interior part. Each of the interior coating paint and the intermediate paint as used herein is a paint of which the main resin is an appropriate resin, such as acrylic resin, alkyd resin and polyester resin. In the coating process shown in FIG. 1, a topcoat paint is applied to the body on which the intermediate paint has been baked. In another embodiment according to the present invention, the intermediate coating process may be provided between a pre-coating process 11 and a topcoat base coating process 12 in a topcoat coating booth 110 to apply the intermediate paint, and a topcoat base paint may be applied thereto in a wet on wet condition. In an alternative embodiment, after the intermediate paint is applied, the topcoat base paint may be applied thereto in a state in which the intermediate paint has been pre-heated to precure.

After completing the intermediate coating, sanding (including wet sanding or dry sanding) is performed if necessary before the body is conveyed into a topcoat coating process. In the topcoat coating process, if a metallic type body color is conveyed at a coating area, a topcoat base paint and a clear paint are applied in a wet on wet condition in the topcoat coating booth. In the topcoat coating process, if a solid type body color is conveyed at the coating area, a topcoat solid paint is applied in the topcoat coating booth together with a clear paint if necessary. Each of the topcoat base paint, the clear paint and the topcoat solid paint as used herein is a paint of which the main resin is an appropriate resin, such as acrylic resin, alkyd resin and polyester resin.

The "metallic type body color" as referred to in the present Description means the whole of a topcoat color coating film that contains a bright pigment, such as aluminum and mica, from the aspect of the exterior color specification for vehicle bodies, while the "solid type body color" means the whole of a color coating film that does not contain such a bright pigment. On the other hand, from the aspect of a multilayer coating film, the "topcoat base paint" as referred to herein means an underlying paint in the topcoat film comprising two or more layers, which corresponds to the metallic base paint in the case of the metallic type body color and to the solid paint in the case of a two-coat solid type body color. In contrast, the "clear paint" as referred to herein means an upper laying paint in the topcoat film comprising two or more layers, which corresponds the clear paint in both cases of the metallic type body color and the two-coat solid type body color. Further from the aspect of the presence or absence of a coloring pigment that defines the exterior color of the vehicle body, each of the topcoat metallic base paint and the topcoat solid paint is a color paint that contains a coloring pigment, while the clear paint is a transparent paint that does not contain a coloring pigment.

Referring again to FIG. 1, the body applied with the topcoat paint is conveyed into a topcoat oven. Here, the body is baked under 130° C. to 150° C. for 15 to 30 minutes, for example, thereby to be formed with the topcoat film on the body exterior part. The film thickness of the topcoat base coating film is 10 μm to 20 μm, for example, the film thickness of the clear coating film is 25 μm to 45 μm, for example, and the film thickness of the topcoat solid coating film is 15 μm to 35 μm, for example. Finally, the body finished with all coating processes passes through an inspection process for finished coating films and a repair process before being conveyed into an assembly line in which vehicle components are assembled into the body.

The above is the overview of the coating line for vehicle bodies. FIG. 1 will be referred to hereinafter which is a process diagram of an embodiment in which the coating method of the present invention is applied to a topcoat coating process 1 of the coating line. As shown in the figure, the topcoat coating process 1 of the present embodiment includes: a pre-coating process 11 of removing dust on the interior and exterior parts of a body B using a wiping cloth and the like; a topcoat base coating process 12 of applying a topcoat base paint (referred also to as a "base paint" in a simple term, hereinafter); a flash-off process 13 of naturally evaporating a solvent in the base paint (water in an aqueous paint (water-based paint) or an organic solvent in an organic solvent type paint); a clear coating process 14 of applying a clear paint; a setting process 15 of leaving the body to evaporate the solvents in the base paint and the clear paint;

and a topcoat baking process 16 of simultaneously baking the base paint and the clear paint.

A vehicle body B of which the exterior color is a solid type body color (one coat solid color) without a clear coat is allowed to pass through the topcoat base coating process 12, and the topcoat solid paint is applied to the interior and exterior parts of the vehicle body B in the clear coating process 14. In contrast, a vehicle body B of which the exterior color is a two-coat solid type body color ("two-coat" means a solid paint and a clear paint applied thereto) is applied with the solid paint in the topcoat base coating process 12 as with the metallic type color, and the clear paint is applied in the clear coating process 14.

To carry out the above topcoat coating process 1, coating facilities are provided which include: a topcoat coating booth 110 for carrying out the pre-coating process 11, the topcoat base coating process 12, the flash-off process 13 and the clear coating process 14; a setting area 150 for carrying out the setting process 15; and a topcoat oven 160 for carrying out the topcoat baking process 16.

The topcoat coating booth 110 is provided with an air conditioner (supply and exhaust apparatus (ventilator)), not shown, having a temperature adjusting function and a humidity adjusting function, so that temperature-controlled air of a constant temperature/constant humidity is supplied at a certain flow amount from the ceiling surface to the floor surface in the booth. This allows prevention of the spread of paint dust and also allows the coating conditions to be stabilized due to the controlled ambient temperature and humidity.

In the topcoat base coating process 12 within the topcoat coating booth 110, four coating robots at the right side and four coating robots at the left side are arranged as denoted by reference numerals 121 to 128, each of which has a hand to which a rotary atomizing coating, gun (not shown) is attached. The base paint is applied to the interior part (such as door opening part) of the body B mainly by two coating robots 121 and 122 located at the entry side, for example, and then applied to the exterior part of the body B mainly by six coating robots 123 to 128 located at the exit side, for example. The number and the work-sharing scheme of the coating robots arranged in the topcoat base coating process 12 are not limited to those in the present embodiment, and may appropriately be set in accordance with the workload and the like for the vehicle body B as a coated object.

The topcoat base coating process 12 is followed by the flash-off process 13 which naturally evaporates the solvent component contained in the wet base coating film. The flash-off process 13 in the present embodiment may evaporate the solvent component contained in the wet base coating film only by the ambient temperature and humidity (including air blow in the coating booth) controlled using the air conditioner provided in the topcoat coating booth 110 while the vehicle body B is being carried by a conveyer, specifically from the time when the base paint was applied to the time when the clear paint is applied. Alternatively, the flash-off process 13 in the present embodiment may be a particular process of performing forcible heating, forcible air blow, and the like. The passing-through time for the flash-off process 13 is 3 to 5 minutes, for example.

The flash-off process 13 is followed by the clear coating process 14 as shown in FIG. 1. Four coating robots at the right side and four coating robots at the left side are arranged herein as denoted by reference numerals 141 to 148, each of which has a hand to which a rotary atomizing coating gun is attached. The clear paint as a first stage 14A is applied by four coating robots 141 to 144 at the entry side of these coating robots 141 to 148. In addition, the clear paint as a second stage 14B is applied by four coating robots 145 to 148 at the exit side of these coating robots 141 to 148. The number and the work-sharing scheme of the coating robots arranged in the clear coating process 14 are not limited to those in the present example, and may appropriately be set in accordance with the workload and the like for the vehicle body B as a coated object. Details of these clear paints applied in the first stage 14A and the second stage 14B will be described later.

The final stage of the clear coating process 14 is provided with an inspection and repair process 14C so that a coating worker can inspect the finishing of the topcoat base coating film and the clear coating film and he can repair coating in the process if necessary. In an alternative embodiment, a repair coating process may be provided between the flash-off process 13 and the first stage 14A to repair the topcoat base coating film at the previous stage to the clear coating by the coating robots 141 to 148.

The setting area 150 for carrying out the setting process 15 has walls and ceilings that surround the body so that dust does not attach to the body passing therethrough. In this setting area 150, a setting process is performed for evaporating the solvent components in the clear coating film and the base coating film applied in the pre-process and preventing coating defects, such as generation of bubbles, in the topcoat baking process 16. Therefore, other particular facilities are not required. It is preferred, however, that a ventilation apparatus or the like is provided for exhausting the evaporated solvent components.

The topcoat oven 160 for carrying out the topcoat baking process 16 has a burner to heat the inlet external air to a predetermined temperature and fans and ducts for introducing the heated hot air to blowing outlets (they are not shown), and the base coating film and the clear coating film are simultaneously baked and cured by the hot air. In general, a radiant heat zone utilizing the radiation heat is provided at the entry side to prevent dust and the like from attaching to the non-cured coating films, and a circulating zone for directly blowing the hot air is provided between the intermediate area and the exit side.

Coating conditions in the clear coating process 14 will then be described.

In the clear coating process 14 of the present embodiment, the coating conditions in the first stage 14A are set different from the coating conditions in the second stage 14B. The clear paints are successively applied in the first stage 14A and the second stage 14B without being baked, and thereafter these non-cured clear coating films are baked in the above-described topcoat oven 160 to form a clear coating film. In the present embodiment, the topcoat base coating film is also simultaneously baked, but a baking process to bake the topcoat base coating film may be provided between the topcoat base coating process and the clear coating process.

The coating conditions in the second stage are such that the painted non-volatility value of the clear paint is larger, the average atomized paint particle size of the clear paint is smaller, and the film thickness of the clear coating film is thinner, compared with the coating conditions in the first stage. In other words, the coating conditions in the first stage are such that the painted non-volatility value of the clear paint is smaller, the average atomized paint particle size of the clear paint is larger, and the film thickness of the clear coating film is thicker, compared with the coating conditions in the second stage. As used herein, the non-volatility value (Non-Volatile Organic Compound) means a percentage of the mass (weight) after baking of the paint with respect to the mass (weight) before baking. As used herein, the painted non-volatility value, which is also called a painted solid content, means a percentage of the paint mass (weight) after applying (and before baking) with respect to the paint mass (weight) before applying. Thus, 'the painted non-volatility value after two minutes from applying' means a percentage when the denominator is the paint mass before applying and the numerator is the mass of the coating film after two minutes from applying the paint to a coated object (and before baking). And the painted non-volatility value is a physical property value that is indicative of how much the ratio of the non-volatile component increases while the paint particles float from the coating gun toward the coated object, i.e., how much the volatile component evaporates.

Specifically in the first stage 14A, the clear paint, which is prepared such that the average atomized paint particle size is reduced to 60 to 100 μm and the painted non-volatility value after two minutes from applying is 60% to 70%, is applied to have a film thickness of 80% to 91% with respect to the total film thickness of the clear coating film. In contrast, in the second stage, the clear paint, which is prepared such that the average atomized paint particle size is reduced to 30 μm or less and the painted non-volatility value after two minutes from applying is 80% to 90%, is applied to have a film thickness of 9% to 20% with respect to the total film thickness of the clear coating film. In addition, the coating conditions in the first stage 14A and the second stage 14B are set such that the painted non-volatility value after two minutes from applying is 60% to 75% after the second stage. This will be described in detail below.

It is known in general that, when a paint is applied to a coated object, film thickness nonuniformity of roughness shape occurs on the coating film surface. When the roughness of the coating film surface is represented by a sine curve, the Orchard-Rhodes equation can be applicable as below:

$$t_{1/2}=k\cdot\eta\cdot\lambda^4/(\gamma\cdot h^3) \quad \text{[Expression 1]}$$

Here, 'k' is 0.001337 (constant), 'η' is the paint viscosity, 'γ' is the surface tension of the paint, 'λ' is the wavelength of a roughness wave, and 'h' is the average film thickness of the coating film. The '$t_{1/2}$' represents the amount of time (half-life) required for the amplitude of the roughness wave to fall to half of its initial value. In the above equation, as the half-life $t_{1/2}$ of the roughness wave is smaller, the coating film surface is flater (i.e., the image sharpness is higher). Therefore, in order that the coating film surface becomes flat, it may be set either to reduce the paint viscosity η, to reduce the wavelength λ of the roughness wave, to increase the surface tension γ of the paint, or to increase the film thickness. However, unduly low paint viscosity η may lead to coating defect such as flow-down and bubbles. On the other hand, unduly large surface tension γ of the paint may lead to coating defect such as repelling. In the above equation, the half-life $t_{1/2}$ of the roughness wave is inversely proportional to the cube of the film thickness h, and increasing the film thickness will thus be effective, but a certain limitation may exist in increasing the thickness of the clear coating film. To overcome the above problems, the present inventor has focused on an aspect that the wavelength λ of the roughness wave in the above equation contributes with its fourth power to reducing the half-life of the roughness wave. A method of obtaining a clear coating film has thus been developed in which the wavelength λ of the roughness wave is reduced thereby to reduce the half-life $t_{1/2}$ of the roughness wave, i.e., to enhance the image sharpness, without increasing the film thickness and with a film thickness comparable with that of single clear film.

According to the clear coating method of the present embodiment, in the first stage 14A, the clear paint, which is prepared such that the average atomized paint particle size is reduced to 60 to 100 μm and the painted non-volatility value after two minutes from applying is 60% to 70%, is applied to have a film thickness of 80% to 91% with respect to the total film thickness of the clear coating film. In addition, in the second stage 14B, the clear paint, which is prepared such that the average atomized paint particle size is reduced to 30 μm or less and the painted non-volatility value after two minutes, from applying is 80% to 90%, is applied to have a film thickness of 9% to 20% with respect to the total film thickness of the clear coating film.

Figure 2:
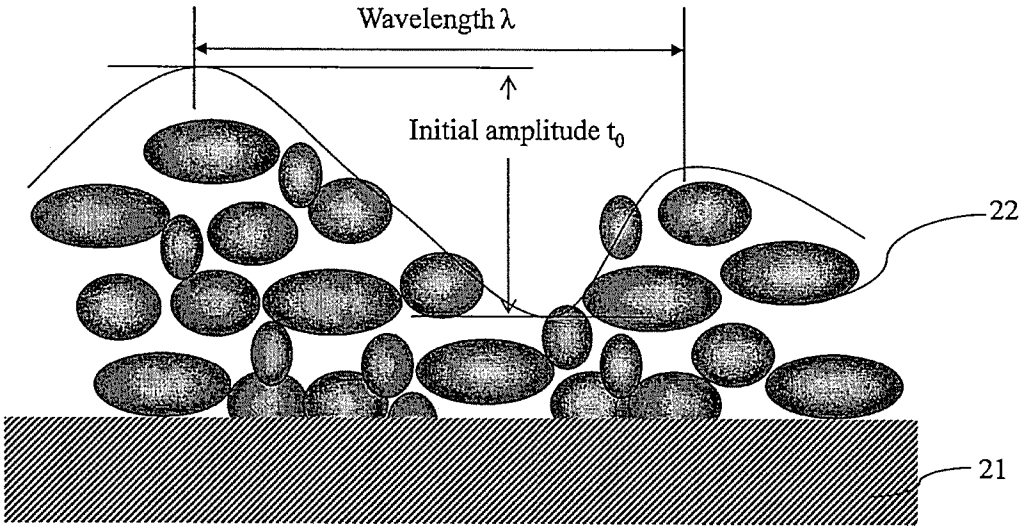
FIG. 2 is a coating film cross-sectional view showing a wet clear coating film applied in a first stage to the surface of a topcoat base coating film in an embodiment of the clear coating method according to the present invention.
Figure 3:
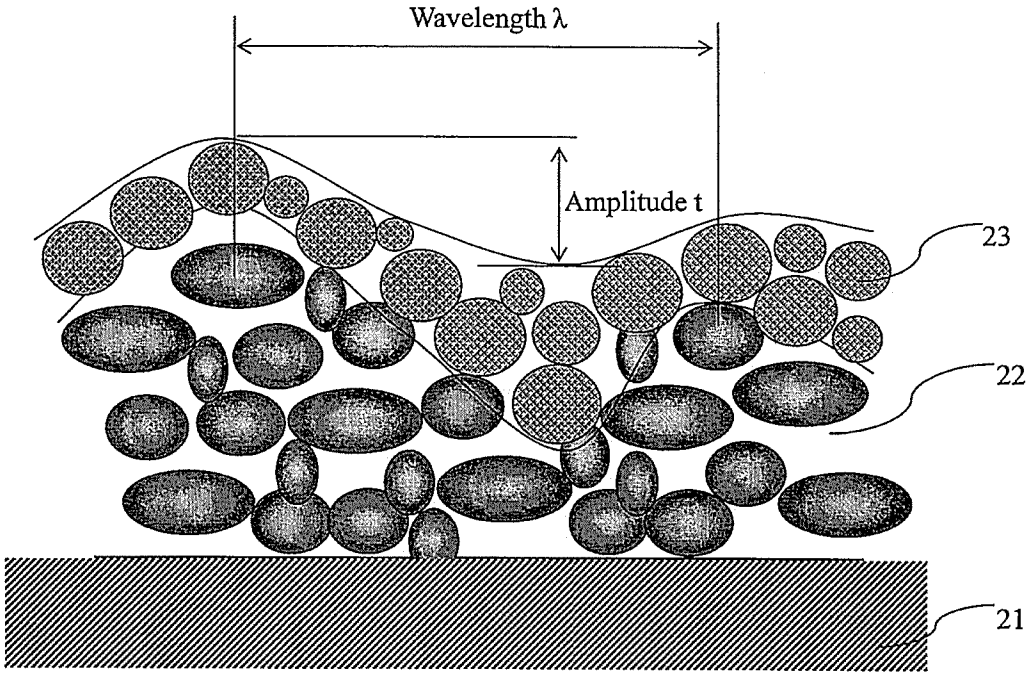
FIG. 3 is a coating film cross-sectional view showing a state in which a wet clear coating film in a second stage is applied to the surface of the wet clear coating film in the first stage of FIG. 2.

FIG. 2 is a cross-sectional view showing the first clear coating film 22 applied in the first stage 14A on the surface of the topcoat base coating film 21. FIG. 3 is a cross-sectional view showing the second clear coating film 23 applied in the second stage 14B further on the surface of the first clear coating film 22. In FIG. 2, the wavelength of the roughness of the first clear coating film 22 corresponds to the wavelength of the roughness wave in the above equation, and the initial amplitude $t_0$ of the first clear coating film 22 corresponds to the height between the maximum height value and the minimum height value of the first clear coating film 22 as shown in the figure.

According to the clear coating method of the present embodiment, the first stage 14A involves thickly applying the clear paint having a small painted non-volatility value and a large average atomized paint particle size. Therefore, the coating film flowability is enhanced because the painted non-volatility value is small. Moreover, the film thickness of the first clear coating film 22 can be increased thereby to ensure the total film thickness of the clear coating film.

On the other hand, the second stage 14B involves thinly applying the clear paint having a large painted non-volatility value and a small average atomized paint particle size. Therefore, the roughness of the surface of the first clear coating film 22 formed in the first stage 14A can be smoothed or flattened as shown in FIG. 3 because the clear paint having a small average atomized paint particle size is thinly applied. Moreover, the surface flow-down immediately after applying can be suppressed because the painted non-volatility value of the clear paint applied in the second stage 14B is set large. Furthermore, the leveling action on the surface of the second clear coating film 23 can also be achieved because the coating film flowability of the second clear coating film 23 is ensured to some extent due to permeation of the solvent from the underlying first clear coating film 22 of which the painted non-volatility value is small (solvent component amount is large).

Figure 4:
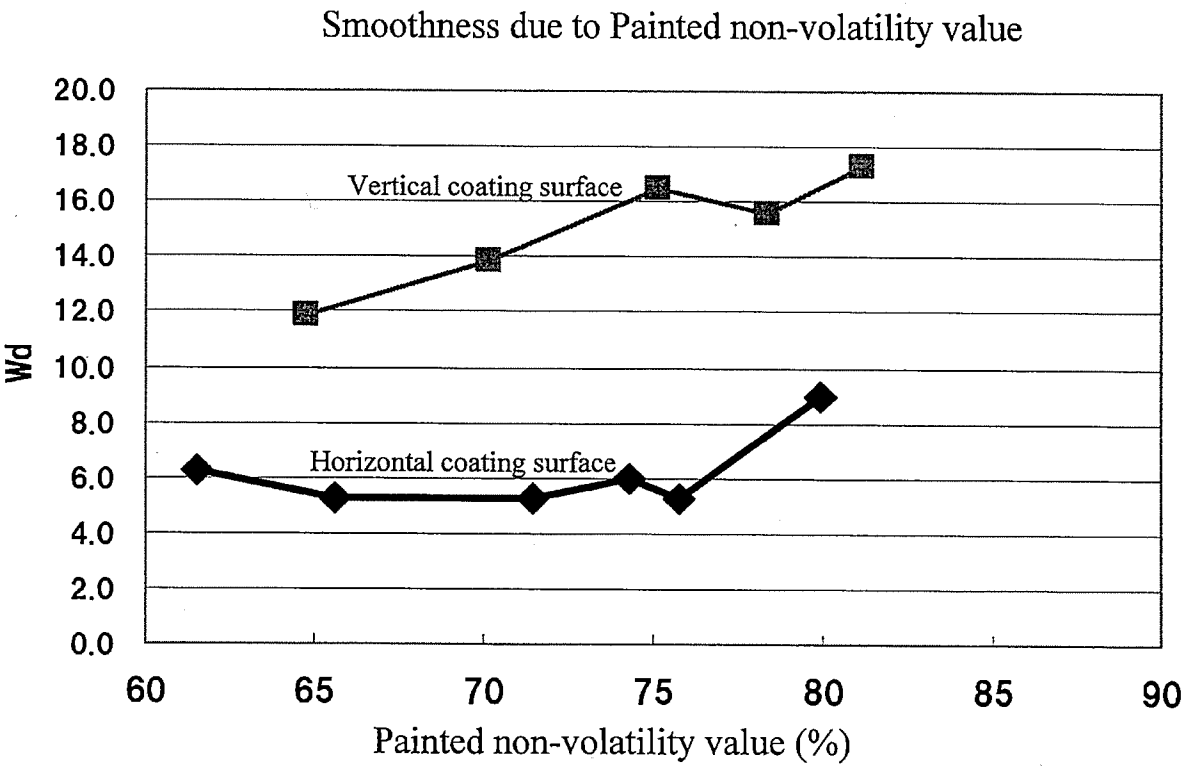
FIG. 4 is a graph for verifying the surface smoothness Wd (wavelength) on each of a horizontal coating surface and a vertical coating surface when the painted non-volatility value after two minutes from applying of the clear coating film after the second stage is 60% to 80% in an embodiment of the clear coating method according to the present invention.

The painted non-volatility value of the clear paint applied in the first stage 14A and the painted non-volatility value of the clear paint applied in the second stage 14B are set such that the painted non-volatility value after two minutes from applying of the clear coating film after the second stage 14B is 60% to 75%. FIG. 4 is a graph for verifying the surface smoothness Wd (wavelength) on each of a horizontal coating surface and a vertical coating surface when the painted non-volatility value after two minutes from applying of the clear coating film after the second stage 14B is 60% to 80%. As the Wd value is smaller, the smoothness (image sharpness) is determined to be good. This experimental results show that both of the horizontal coating surface and the vertical coating surface exhibit good smoothness when the painted non-volatility value is within a range of 60% to 75% and exhibit poor smoothness when the painted non-volatility value is beyond this range.

To set the painted non-volatility value after two minutes from applying of the clear coating film after the second stage 14B to 60% to 75%, it is preferred to prepare the clear paint applied in the first stage 14A so that the painted non-volatility value after two minutes from applying is 60% to 70% and prepare the clear paint applied in the second stage 14B so that the painted non-volatility value after two minutes from applying is 80% to 90%. For preparation of these painted non-volatility values, two clear paints may be of the same material and may have the same solvent and the same dilution ratio, and a target painted non-volatility value can be obtained by adjusting the coating conditions in using a coating gun (such as average atomized paint particle size via rotation speed) and/or adjusting the film thickness. This allows one type of paint to be used as the paints for forming the first clear coating film and the second clear coating film. As a result, two systems of the paint pipe lines can be integrated into one system, and the initial investment can accordingly be reduced, such as in installation of the paint pipe lines and paint tanks and other coating equipment. In an alternative embodiment, preparation of these painted non-volatility values may typically be achieved by appropriately adjusting the type of solvent (boiling point) and/or the dilution ratio of solvent.

Figure 5:
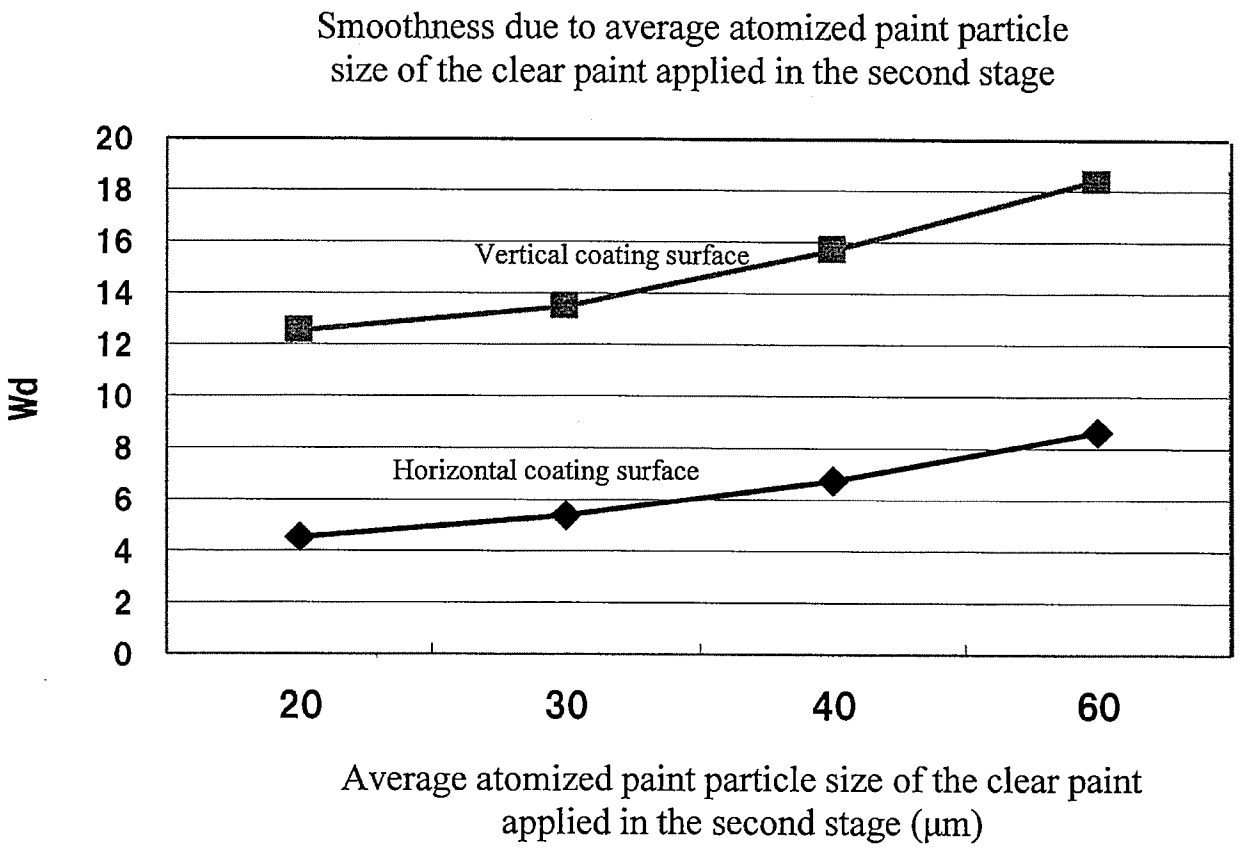
FIG. 5 is a graph for verifying the surface smoothness Wd (wavelength) on each of a horizontal coating surface and a vertical coating surface when the average atomized paint particle size of the clear paint applied in the second stage is 20 to 60 μm in an embodiment of the clear coating method according to the present invention.

It is preferred that the average atomized paint particle size of the clear paint applied in the first stage 14A and the average atomized paint particle size of the clear paint applied in the second stage 14B are such that the average atomized paint particle size is reduced to 60 to 100 μm in the first stage 14A and the average atomized paint particle size is reduced to 30 μm or less in the second stage 14B. In this case, the reduced particle size in the second stage 14B is particularly important. FIG. 5 is a graph for verifying the surface smoothness Wd (wavelength) on each of a horizontal coating surface and a vertical coating surface when the average atomized paint particle size of the clear paint applied in the second stage 14B is 20 to 60 μm. This experimental results show that both of the horizontal coating surface and the vertical coating surface exhibit good smoothness when the average atomized paint particle size is within a range of 30 μm or less and exhibit poor smoothness when the average atomized paint particle size is beyond this range. These average atomized paint particle sizes may be adjusted by appropriately adjusting the rotation speed of a rotary atomizing coating gun (so-called bell-type coating gun), the dilution ratio of solvent, and/or the paint viscosity. The average atomized paint particle size of the clear paint applied in the second stage 14B may be 30 μm or less, and may preferably be smaller within the functionality of the coating gun.

Figure 6:
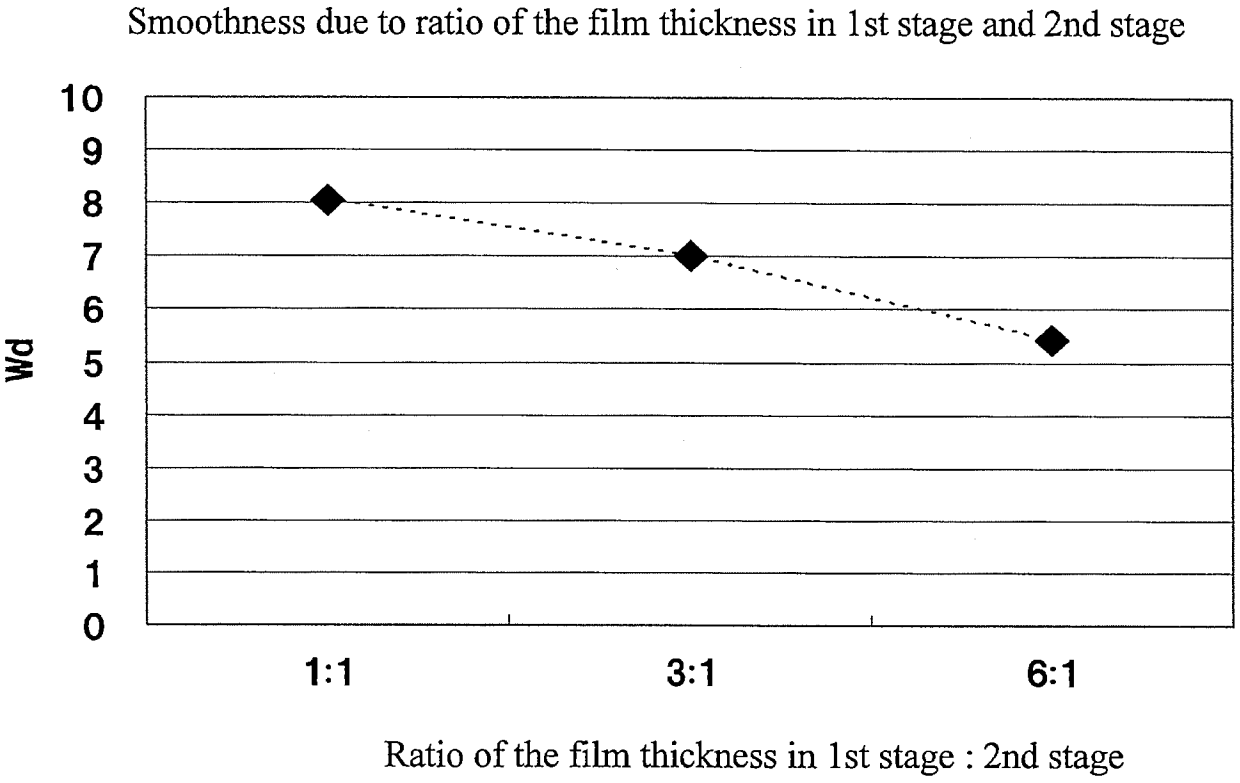
FIG. 6 is a graph for verifying the surface smoothness Wd (wavelength) on each of a horizontal coating surface and a vertical coating surface when the ratio of the film thickness of the clear coating film in the first stage and the film thickness of the clear coating film in the second stage is 1:1, 3:1, and 6:1 in an embodiment of the clear coating method according to the present invention.
Figure 7:
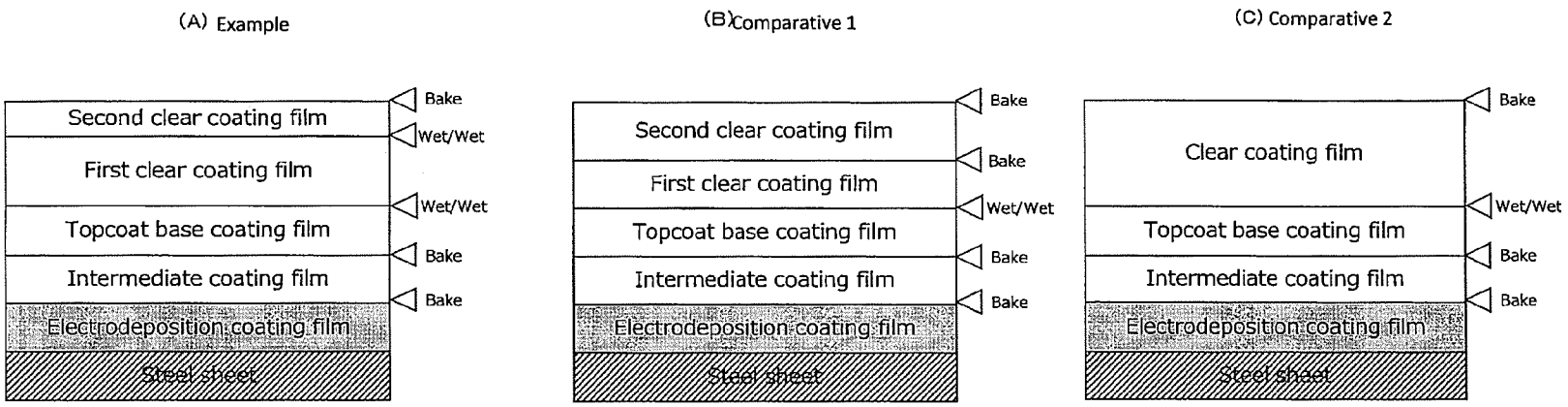
FIG. 7(A) is a cross-sectional view showing a multilayer coating film according to an example to which an embodiment of the clear coating method according to the present invention is applied.
FIG. 7(B) is a cross-sectional view showing a multilayer coating film according to Comparative Example 1.
FIG. 7(C) is a cross-sectional view showing a multilayer coating film according to Comparative Example 2.
Figure 8:
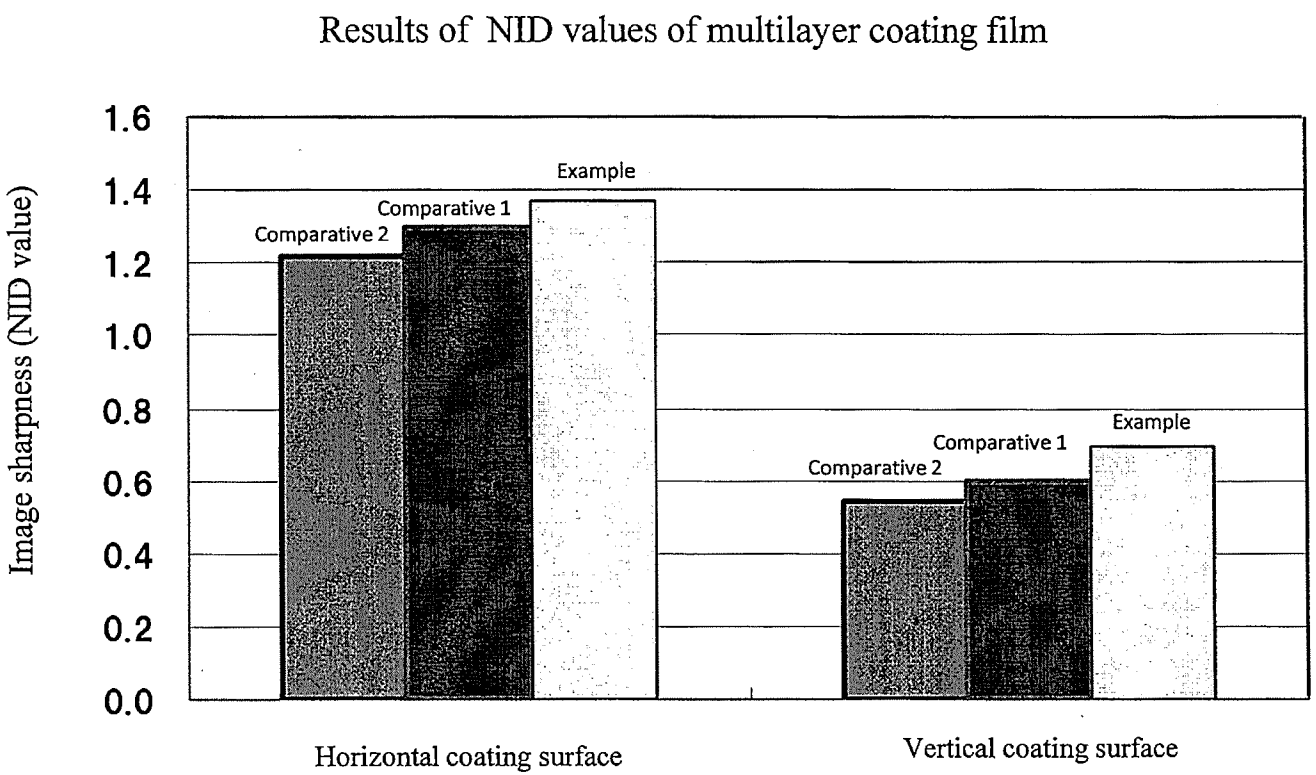
FIG. 8 is a graph showing results (NID values) obtained by measuring the image sharpness of the multilayer coating films of FIG. 7(A) to FIG. 7(C).

The ratio of the film thickness of the clear coating film applied in the first stage 14A and the film thickness of the clear coating film applied in the second stage 14B may preferably be within a range that includes 6:1, and specifically within a range of 4:1 to 10:1. In terms of a value equivalent to the ratio of the film thickness with respect to the total film thickness of the clear coating film, it is preferred that the first clear coating film 22 has a thickness of 80% to 91% with respect to the total film thickness and the second clear coating film 23 has a thickness of 9% to 20% with respect to the total film thickness. FIG. 6 is a graph for verifying the surface smoothness Wd (wavelength) on each of a horizontal coating surface and a vertical coating surface when the ratio of the film thickness of the first clear coating film 22 and the film thickness of the second clear coating film 23 is 1:1, 3:1, and 6:1. This experimental results show that both of the horizontal coating surface and the vertical coating surface exhibit good smoothness when the ratio of the film thickness of the first clear coating film 22 and the film thickness of the second clear coating film 23 is within a range that includes 6:1 and exhibit poor smoothness when the film thickness ratio of the first clear coating film 22 is small. Specifically, when the total film thickness of the clear coating film is 35 μm, it is preferred that the first clear coating film 22 has a film thickness of 28 to 32 μm and the second clear coating film 23 occupies the balance, i.e., has a film thickness of 3 to 7 μm FIG. 7(A) is a cross-sectional view showing a multilayer coating film according to an example to which the clear coating method of the present embodiment is applied, FIG. 7(B) is a cross-sectional view showing a multilayer coating film according to Comparative Example 1, and FIG. 7(C) is a cross-sectional view showing a multilayer coating film according to Comparative Example 2. While all of the multilayer coating films are produced under the same coating conditions from the steel sheets to the base coating films, Comparative Example 1 shown in FIG. 7(B) is produced using a baking process provided for between the first clear coating film and the second clear coating film, and Comparative Example 2 shown in FIG. 7(C) is formed with the clear coating film of one coat. All of the clear coating films have the same total film thickness. FIG. 8 is a graph showing results (NID values) obtained by measuring the image sharpness of the multilayer coating films of FIG. 7(A) to FIG. 7(C) using an image sharpness measuring apparatus developed by NISSAN MOTOR CO., LTD. As the value of image sharpness on the vertical axis is larger, the smoothness is determined to be good.

From the results of FIG. 8, it has been confirmed that, according to the clear coating method of the present example, coating films having higher image sharpness can be obtained for a horizontal coating surface and a vertical coating surface compared with Comparative Example 1 which is double clear of so-called two-coat two-bake and also compared with Comparative Example 2 which is single clear of one-coat one-bake.

As described above, according to the clear coating method of the present embodiment, a coating film exhibiting higher image sharpness can be obtained compared with a double clear coating film of so-called two-coat two-bake. Moreover, the coating process can be reduced and the coating can be completed in a shorter period of time compared with the double clear of two-coat two-bake because the clear coating film is formed by wet on wet without using a baking process for between the first clear coating film 22 and the second clear coating film 23. Furthermore, the running cost of energy consumption can be reduced because that baking process is unnecessary.

DESCRIPTION OF REFERENCE NUMERALS

1 . . . Topcoat coating process
11 . . . Pre-coating process
12 . . . Topcoat base coating process
13 . . . Flash-off process
14 . . . Clear coating process
14A . . . First stage
14B . . . Second stage
14C . . . Inspection and repair process
15 . . . Setting process
16 . . . Topcoat baking process

21 . . . Topcoat base coating film
22 . . . First clear coating film
23 . . . Second clear coating film
110 . . . Topcoat coating booth
121-128, 141-148 . . . Coating robot
150 . . . Setting area
160 . . . Topcoat oven

The invention claimed is:

1. A clear coating method comprising:

spraying a first clear paint on a topcoat base coating film under a coating condition in which the first clear paint has a $NV_{2m}$ of 60% to 70%, the $NV_{2m}$ being a painted non-volatility value after two minutes from applying, and an average atomized paint particle size of the first clear paint is 60 μm to 100 μm, thereby forming a first wet clear coating film having a thickness of 80% to 91% with respect to a total clear coating film thickness in a first stage; and successively spraying a second clear paint on the first wet clear coating film under a coating condition in which the second clear paint has a $NV_{2m}$ of 80% to 90% and an average atomized paint particle size of the second clear paint is 30 μm or less without baking the first wet clear coating film, thereby forming a second wet clear coating film having a thickness of 9% to 20% with respect to the total clear coating film thickness in a second stage.

2. The method as set forth in claim 1, wherein a wet clear coating film, including the first wet clear coating film and the second wet clear coating film after the second stage, has a $NV_{2m}$ of 60% to 75%.

* * * * *